United States Patent [19]

Hiles

[11] Patent Number: 5,036,444

[45] Date of Patent: Jul. 30, 1991

[54] HIGH INTENSITY LAMP

[75] Inventor: Brian A. Hiles, La Costa, Calif.

[73] Assignee: Malyne Enterprises, Inc., Carlsbad, Calif.

[21] Appl. No.: 581,757

[22] Filed: Sep. 13, 1990

[51] Int. Cl.[5] ..... F21L 7/00

[52] U.S. Cl. ..... 362/188; 362/263; 362/265

[58] Field of Search ..... 362/188, 202, 205, 263, 362/265

[56] References Cited

U.S. PATENT DOCUMENTS

| | | | |
|---|---|---|---|
| 3,648,045 | 3/1972 | LeVantine et al. | 362/265 |
| 3,689,759 | 9/1972 | Dill | 362/188 |
| 3,702,395 | 11/1972 | Rosendahl | 362/263 |

*Primary Examiner*—Stephen F. Husar

*Attorney, Agent, or Firm*—Brown, Martin, Haller & McClain

[57] ABSTRACT

A long range, high intensity lamp or spotlight comprises a head portion at one end having a window opening and a handle portion connected to the head portion and containing starter circuitry for controlling operation of the lamp. A parabolic mirror is mounted in the head portion to face the window opening, and a high intensity electric arc bulb such as a Xenon bulb is adjustably mounted within the mirror so that the electrode gap is located as close as possible to the focus of the mirror. An adjustable mounting base allows the position of the bulb to be adjusted until the optimum position is reached, at which point the bulb is secured in its position.

19 Claims, 4 Drawing Sheets

10
12
14
16
18
22
24
26
28
29
30
31
32
34
35
36
38
40
41
42
44
46
68
70
74
80
84
86
87
88
90
92
93
95
98
110
112, 114
116
118
120
122
128
132
134
136
138
140
142
171
2
3

18
14
62
68
74
88
95
142
143
4

14
16
74
90
110
112, 114
116
118
120
121

HIGH INTENSITY LAMP

BACKGROUND OF THE INVENTION

1. Field of the Invention

The present invention relates generally to lamps, and is particularly concerned with hand held or portable flashlights for use as spotlights, underwater lamps or for general long distance visibility in dark conditions.

2. Description of Related Art

Portable or hand carried flash lights or flash lamps have long been used as convenient light sources under various circumstances, for example when walking at night or in other dark situations where no other light source is readily available. Currently available flash lights are typically relatively low power, low intensity light sources and have a fairly short range.

SUMMARY OF THE INVENTION

It is an object of this invention to provide a new and improved portable flashlamp having higher intensity and longer range than standard flashlamps.

According to the present invention, a lamp assembly is provided including an outer housing with a handle for gripping by a user, the housing having a window opening for transmitting a light beam, a parabolic mirror within the housing facing the window opening, an electric arc lamp or bulb mounted at the focus of the parabolic mirror via an adjustment mechanism permitting precise positioning of the bulb, with its electrode gap at the focus of the mirror and a power supply or input for driving the lamp.

The electric arc lamp contains a metallic vapor or gas, preferably Xenon, which produces a high intensity light beam. The adjustment mechanism allows the lamp to be tilted relative to the central axis of the mirror, and also to be moved axially back and forth relative to the front end of the mirror, until the focal position is found. At this point the lamp is secured in position. Preferably, these adjustments are made during manufacture of the lamp.

In the preferred embodiment of the invention the power supply is connected to the lamp via starter circuitry for controlling the lamp operation under precise conditions. This includes a voltage regulation arrangement for elevating the bulb operating voltage to allow for any manufacturing tolerances and to correct for wear and tear on the bulb electrodes and any operating variations due to magnetism or shock, ensuring that the bulb is always operated at its optimum level, and optimizing the position of the arc between the two electrodes.

BRIEF DESCRIPTION OF THE DRAWINGS

The present invention will be better understood from the following detailed description of a preferred embodiment of the invention, taken in conjunction with the accompanying drawings, in which like reference numerals refer to like parts, and in which.

DESCRIPTION OF THE PREFERRED EMBODIMENT

Figure 1:
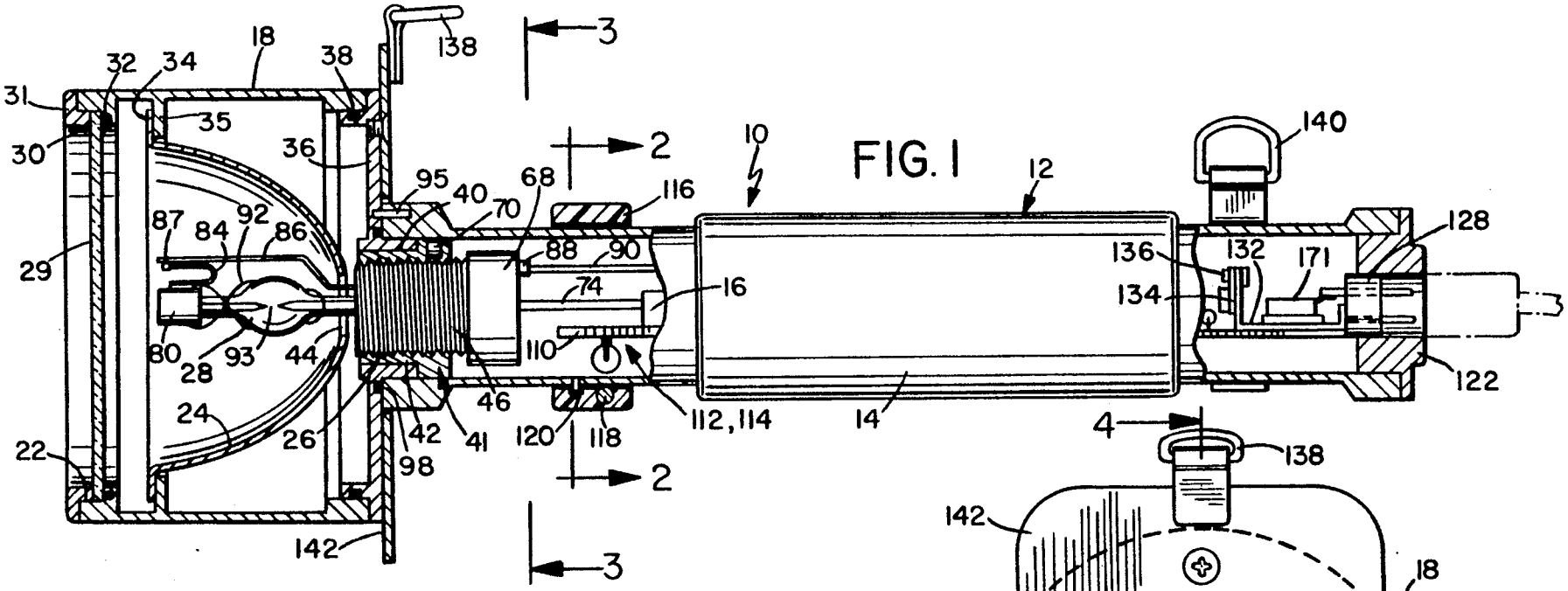
FIG. 1 is a side elevation view of a lamp assembly according to a preferred embodiment of the invention, partially broken away to illustrate the components of the lamp.
Figure 3:
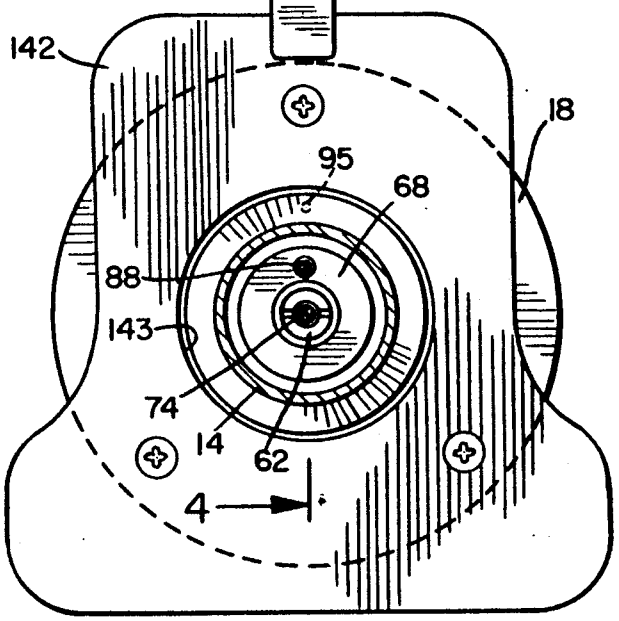
FIG. 3 is a cross-section on the lines 3—3 of FIG. 1.

The drawings illustrate a high intensity lamp or flashlight 10 according to a preferred embodiment of the present invention. The lamp is of a portable or hand held design and includes an outer, generally cylindrical housing 12 of standard flashlight-like dimensions having an elongate handle portion or casing 14 in which starter circuitry 16 for operating the lamp is mounted and an enlarged head portion 18 formed separately from the handle portion 14 and attached to it by suitable fasteners such as screws or the like (not illustrated).

Figure 4:
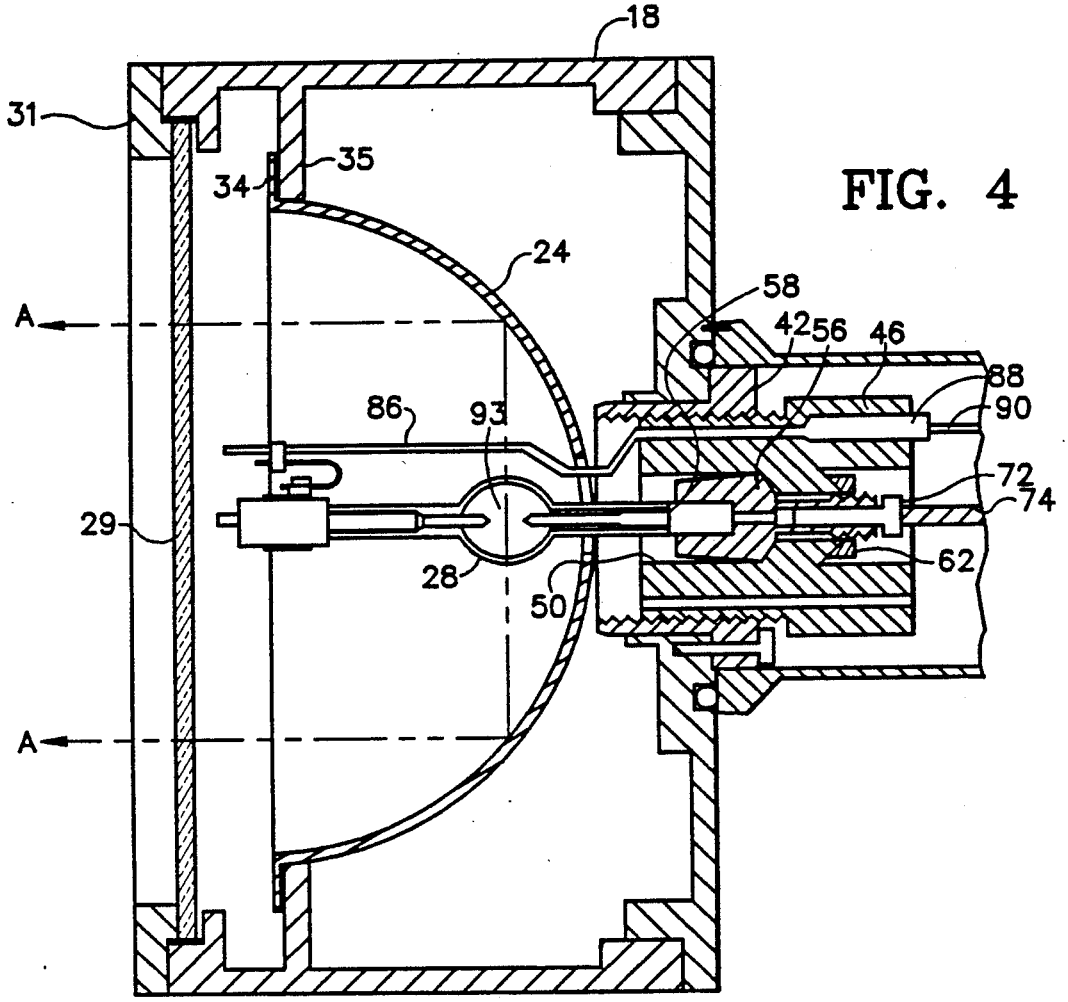
FIG. 4 is an enlarged cross-section of the head of the lamp, illustrating the bulb adjustment mechanism with some parts omitted for clarity.

The handle and head portions of the housing are hollow and contain all the lamp components. The head portion 18 has a window opening 22 at its outer end for transmitting a light beam, and a parabolic mirror 24 is mounted in the head portion to face the window opening, as best seen in FIGS. 1 and 4. The parabolic mirror is preferably of aluminum treated with Brytal, with a hole 26 bored in the center of its base for mounting an electric arc bulb 28, preferably a Xenon bulb. The Xenon bulb is preferably a 75 Watt bulb. The window opening 22 is preferably covered with a disc of a VHRT shock resistant glass which is chemically treated to filter out the ultra violet component from the beam, which would be harmful to the eyes. The glass is 90 percent efficient at transmitting visible light. The glass disc 29 is seated on an annular ledge 30 at the outer end of the head 18, and is secured in place via an outer sealing ring 31 positioned over the disc and secured to the outer end of head portion 18 via suitable fasteners such as screws (not illustrated). A ball joint or sealing ring 32 is located between disc 29 and the ledge 30, and is flattened by tightening of the fastener screws to provide complete tightness.

The parabolic mirror has an outer rim or lip 34 which is seated on an annular shoulder 35 on the inner surface of head 18 and secured in place via any suitable fastening means, such as screws (not illustrated). A steel washer (not illustrated) may be located between the rim 34 and screws to reduce the risk of warping of the mirror. The base wall or plate 36 of the head 18 is preferably formed separately and releasably secured to the remainder of the head via fasteners such as screws (not illustrated). An 0-ring seal or joint 38 ensures tightness of the connection. The base plate 37 has a central opening 40 in which an adjustable mounting assembly 41 for Xenon bulb 28 is mounted.

Figure 5:
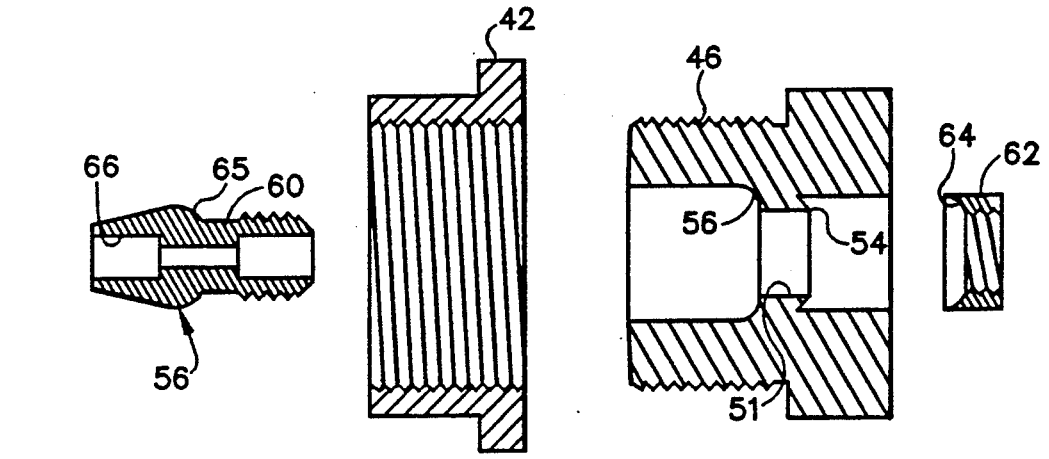
FIG. 5 is an exploded view of the parts of the bulb adjustment mechanism with some parts omitted for reasons of clarity.

The mounting assembly 41 is in four parts, and is illustrated in more detail in FIGS. 4 and 5. Assembly 41 includes an outer ring or sleeve 42 secured in the opening 41 via three angularly spaced locking screws (not illustrated) arranged at angular spacings of 125 degrees/125 degrees/110 degrees, respectively. The sleeve 42 has internal screw threads 44. An outer bulb supporting member 46 of insulating material such as Teflon (Registered Trade Mark), having external screw threads is threadably engaged Within sleeve 40. The bulb supporting member 46 has a central through bore 50 of stepped diameter having a reduced diameter central portion 51, the larger diameter portions having concave and convex spherical bases or seating surfaces 52, 54, respectively, at their inner ends. An inner bulb support or base member 56 having a head 58 and stem 60 is mounted in one larger diameter end of the bore 50 with its stem 60 projecting through the smaller diameter central portion 51 of the bore. Stem 60 is screw threaded and receives a similarly screw threaded spherical nut 62 at its outer end, the spherical surface 64 of the nut seating against the spherical seating surface 54, as best illustrated in FIG. 4. The head 58 of base member 56 has a spherical surface 65 matching that of seating surface 52 against which it is seated, and has a bore 66 at its outer end in which one end of bulb 28 is secured.

This mounting arrangement allows the position of bulb 28 relative to mirror 24 to be precisely adjusted. The outer bulb supporting member 46 is moved axially in or out for longitudinal adjustment of the bulb position, by rotating its enlarged end 68 clockwise or anticlockwise. The inner base member 56 can be tilted in any direction for transverse adjustment. Once the desired position is reached, nut 62 is tightened to hold the member 56 at the desired orientation. Similarly, a locking screw 70 extending transversely through the outer sleeve can be tightened to lock the outer supporting member 46 in any desired position. These adjustments are made during manufacture of the lamp and prior to securing the lamp head to the casing or handle portion. The bulb position is adjusted until the gap between the electrodes is located precisely at the focus of the mirror, to produce a high candle power, tunnel-like beam of light, which is as close as possible to parallel, with less than divergence, as indicated by the arrows A in FIG. 4. The optimum bulb position is detected by centering a spot of light produced by the lamp and adjusting the bulb position until the spot is centered and the diameter of the spot is at a minimum. At this point screw 70 and nut 62 are tightened.

The inner base member 56 holding the bulb is of conductive material, for example brass treated with gold, to transmit electricity to the cathode of the Xenon bulb. The member 56 receives a male connector 72 at its outer end which is connected via conductor wires 74 to the starter circuitry 16 in the casing 14, which will be described in more detail below in connection with FIGS. 5 and 6.

The Xenon bulb can be seen in more detail in FIGS. 1 and 4. As mentioned above, the cathode connection to the power supply and starter or control circuitry is made via base member 56. The anode connection is made via conductive end clip 80 on the free end of the bulb which is secured via conductive wires 84 to a conductive pole member 86 which extends into support member 46, where it is welded to a second male connector 88 secured via wiring 90 to the power supply and starter circuitry. End clip 80 has some resilience to produce a spring effect, crimping the wires 84 to the bulb end. The conductive wires 84 are flexible to avoid any mounting rigidity of the Xenon bulb. In the event of impact or vibration, the bulb can vibrate with little risk of damage. Preferably, the conductive wires 84 are of copper treated with Rhodium. They are secured to pole member 86 via a crimping clip 87 of conductive material. The pole member is formed to avoid touching the parabolic mirror, as illustrated in FIG. 4. Preferably, a length of nickel wire 92 also secured to pole member 86 surrounds the length of the bulb to energize the interior of the bulb and reduce the starting voltage level. The Xenon bulb has only a very small gap 93 between its electrodes, normally of the order of 0.0134 inches, and it is this gap which is centered on the focus of the mirror in order to achieve the desired, substantially parallel, high power light beam.

Once the bulb has been positioned and the locking nut and screw tightened, the casing or handle portion 14 is secured to the head via six angularly spaced screws (not illustrated). A centering pin 95 projecting from a bore in the end face of the casing extends into a corresponding blind bore in the base plate 36 to position the head and casing correctly. Ball joint 98 ensures tightness between the base and casing.

Figure 2:
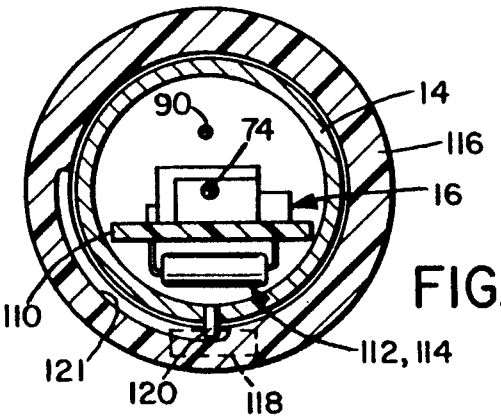
FIG. 2 is an enlarged cross-section on the lines 2—2 of FIG. 1.

As illustrated in FIGS. 1 and 2, the casing 14 comprises a hollow tubular member and contains the power supply and starter circuitry 16 for operating the Xenon bulb under precisely controlled conditions, as explained in more detail below in connection with FIGS. 5 and 6. The circuit components are provided on printed circuit board 110 mounted in the casing 14. Two magnetic switches 112, 114 control operation of the circuitry to activate the lamp, and are switched on and off via a magnetic switch comprising a sleeve 166 rotatably mounted on the casing at the switch location, which is rotated into an ON position to move magnet 118 within the sleeve into a position to excite the two switches. A lock pin 120 projects from the casing for engagement in an elongate slot 121 in the sleeve or ring 116 to restrict rotation of the magnetic ring in opposite directions between predetermined ON and OFF end positions which will preferably be suitably marked on the outer surface of the casing. End cap 122 seals the outer end of the casing 14 and is secured to the end of the casing via screws or the like (not illustrated) with a ball joint or seal located between the opposing faces to form a seal. A male power supply connector 128 is mounted in the end cap via suitable fasteners for receiving power to operate the unit, from an external battery power pack, a mains power outlet, or an automobile cigarette lighter, for example. The inner wall of the casing is coated with Epoxy material along its whole length, which adheres to the opposite side edges of the printed circuit board to secure it in place.

The printed circuit board is secured to the end cap via a cooler bracket 132 of aluminum which positions the circuit and also evacuates heat generated in the circuitry to the end cap, which is preferably formed of duraluminum. One of the driver components 134 of the circuitry, to be described in more detail below, is tightened against the cooler bracket via bolt 136 so that heat generated in that component will be dissipated.

Spaced buckles 138, 140 are mounted on the outside of the housing for receiving a shoulder strap (not illustrated) for carrying the lamp. An anti-roll stand or plate 142 at the junction between the head and casing prevents rolling of the housing if the lamp is placed on a flat surface. The plate has a central opening 143 through which the casing 14 projects.

The circuitry for controlling operation of the Xenon bulb will now be described in more detail with reference to FIGS. 6 and 7. Referring first to the block diagram of FIG. 6, the circuit has a suitable 12 Volt power supply 144, which is connected via end connector 128 and which may comprise a battery, a vehicle cigarette lighter, or a mains power input from a wall socket, for example. Power supply 144 is connected via the on off switches 112, 114 (SW10 and SW12 in FIG. 7) to a power switching circuit and signal amplifier 146 for raising the voltage level. The power supply and the output of signal amplifier 146 are both connected to high frequency transformers 148 which boost the voltage from 500 volts to 10,000 volts to produce a very high voltage peak which ignites the Xenon bulb 28. The bulb is connected to a tension divider 150 which interprets whether the bulb is lit or not. The output of tension divider 150 is connected to a voltage regulator 152 to correct the power input to the Xenon bulb in the event of any variation in power loss due to aging of the bulb, wear and tear on the electrodes, and so on. The regulation level output signal 154 from voltage regulator 152 enters a pulse wide modulation circuit 156, which is also connected to the output of frequency oscillator 158 which is arranged to generate a triangle signal of predetermined frequency. This is converted to a square wave signal of amplitude dependent on the input regulation level by the modulation circuit 156.

The output modulation signal 160 is connected to the power switching circuit to raise the voltage dependent on the regulation level. The tension divider is also connected to a multi-data input distribution switch 162, which is also connected to a time delay unit 164 introducing a predetermined delay time, suitably 3 seconds. This section of the circuitry is arranged to cut off power to the circuit if the lamp is not started within 3 seconds of turning on the unit. A minimum of two seconds delay is required before re-lighting the lamp. Finally, a low voltage stand by circuit 166 is also connected to cut off power if the power is at less than 10 Volts. All of the circuits or units are preferably custom IC chips.

Figure 6:
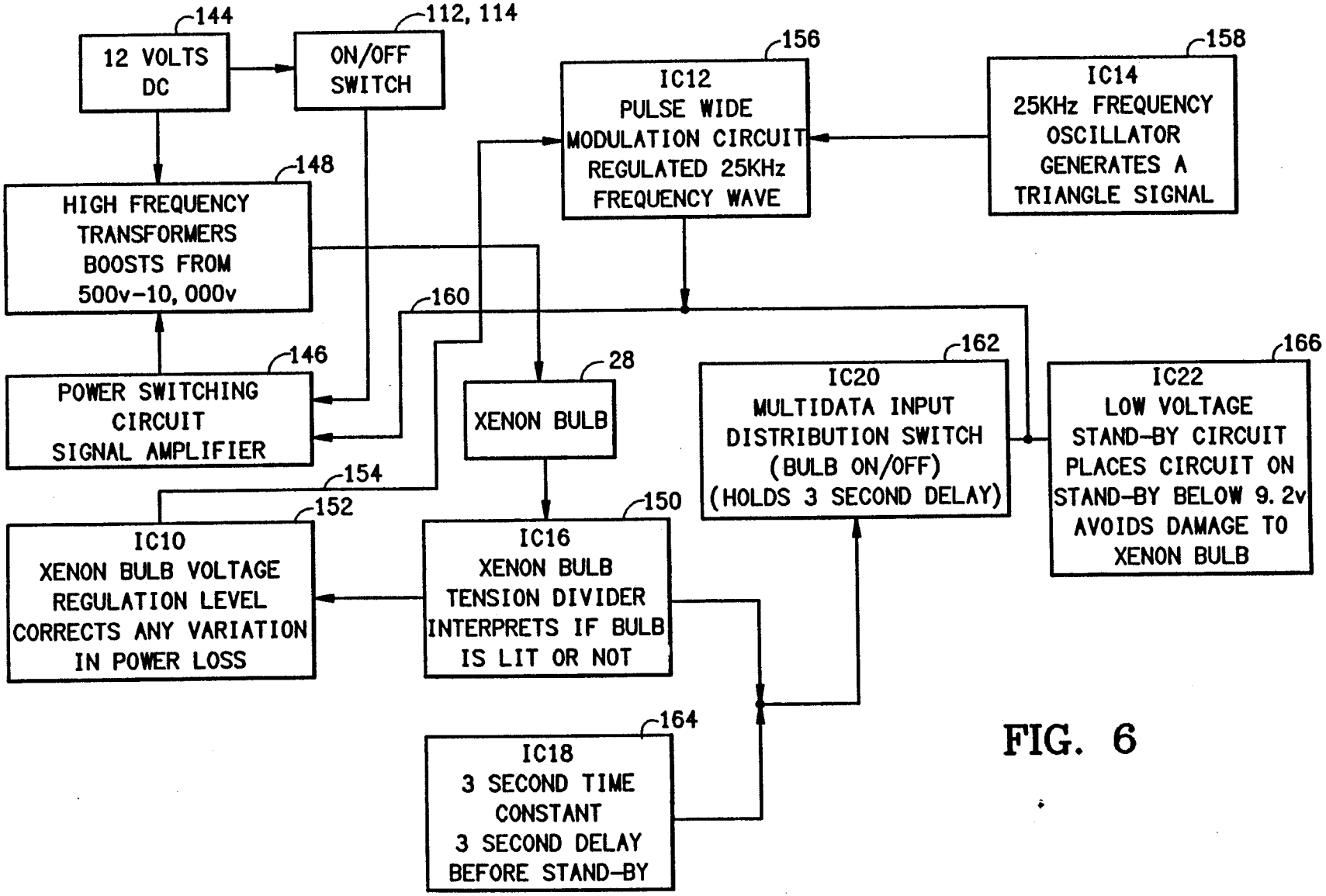
FIG. 6 is a block diagram of the starter circuitry for the lamp of FIGS. 1–5.
Figure 7:
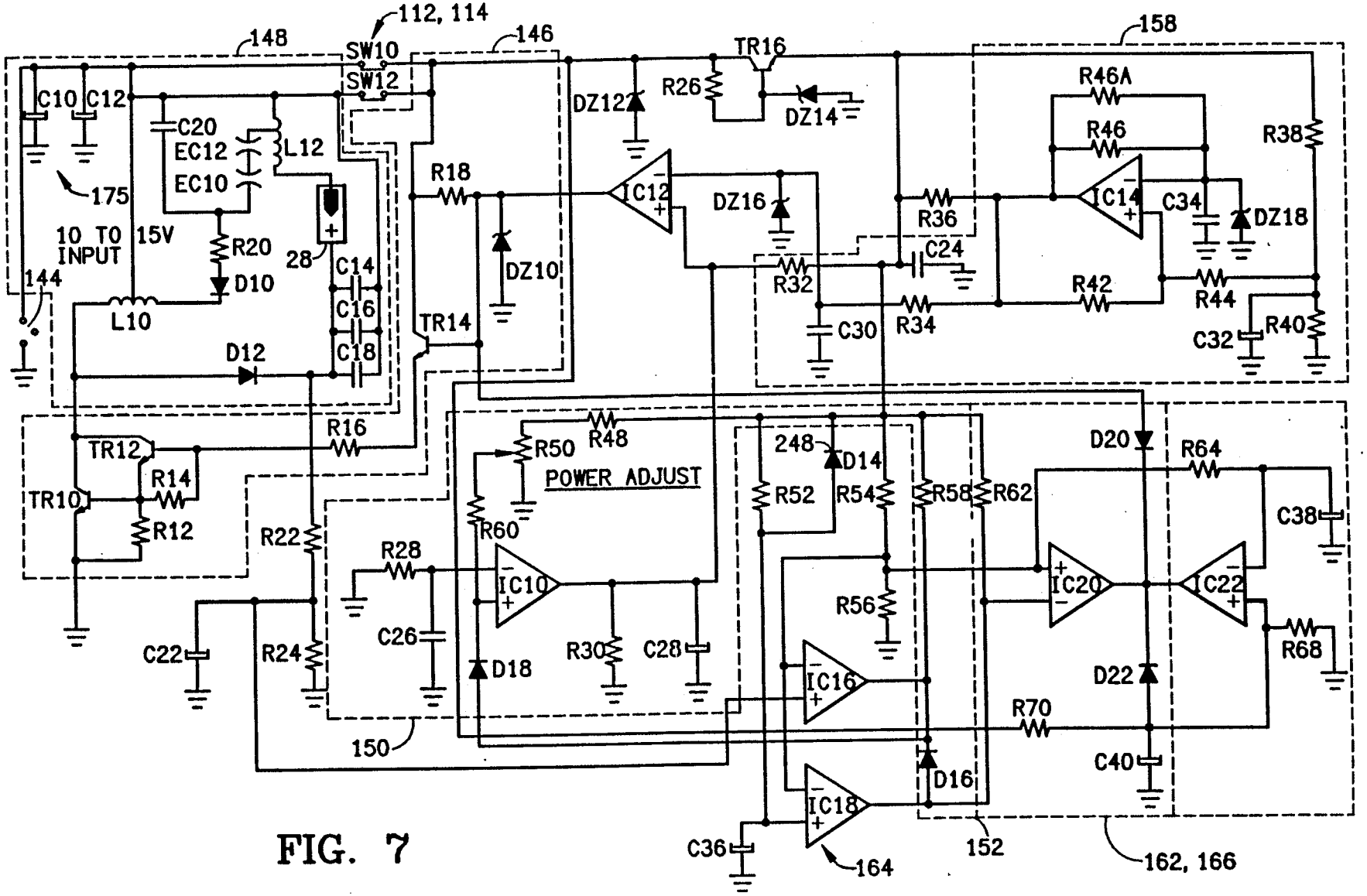
FIG. 7 is a schematic of one possible circuit configuration for the starter circuitry of FIG. 6.

FIG. 7 is a schematic illustrating one possible embodiment of a circuit constructed to perform the functions discussed above in connection with the block diagram of FIG. 6. It will be understood by those skilled in the field that alternative circuits may be devised to perform equivalent functions. The power supply 144 is connected to the high frequency transformers L10, L12, and is connected via switches SW10, SW12 to the poWer switching part of the circuitry. When the unit is plugged into a suitable 12 Volt DC power source, the unit is on stand-by. When the outer magnetic case switch is rotated to the ON position, switches SW10 and SW12 are closed to complete the starting circuit. 12 volts are sent to the TR16 transistor to produce a 5 Volt DC signal which operates all the integrated circuits. At this time, IC14 will generate a near 25 KHz triangle signal. The output of IC10 sets the Xenon bulb voltage regulation level. Potentiometer R50 adjusts the reference to IC10. As the bulb ages this power control corrects for wear and tear on the bulb electrodes by elevating the bulb operating voltage. Variations of the Xenon arc due to shocks and magnetism are also corrected.

The outputs of IC10 (regulation level) and IC14 (triangle wave generator) are connected to the respective inputs of IC12 and a regulated 25 KHz signal will be delivered from its output to the base of transistor TR14.

Transistor TR14 amplifies the 25 KHz signal at its emitter and then activates power switching amplifiers or drivers TR10 and TR12 through resistor R16. Transistors TR10 and TR12 will then function at near 25 KHz frequency. Resistors R12 and R14 polarize the low level of transistors TR10, TR12. Power switching transistor TR10 and diode D12 will deliver about 100 volts to the Xenon bulb through transformer L10, resulting in an elevation in its output voltage. Capacitors C10 and C12 act as input filters. Capacitor C20 is charged through diode D10 and resistor R20 to 500 volts. When it reaches 500 volts, it discharges into high voltage kicking coil or transformer L12 through spark gaps EC10, EC12. Kicking coil L12 then transmits a very high voltage peak of about 10,000 volts into the Xenon bulb 28, normally igniting the bulb within three seconds. Capacitors C14, C16 and C18 are high frequency capacity filters.

After the flash on ignition the power level is controlled by the voltage regulator, and the voltage in the Xenon bulb will decrease to approximately 13.8 to 14.1 volts, which is imposed by the bulb. The tension divider comprising resistors R22, R24 connected to the bulb output and to the input of comparator IC16 compares the bulb output to a standard voltage input of 5 volts via tension dividing resistors R54, R56, which divide the voltage by 2 to furnish an input to IC16, IC18, IC20 and IC22. When the bulb is off, the comparator IC16 will be switched on. The comparator output voltage is zero if the bulb is lit and at a maximum when the bulb is not on. Capacitor C22 provides a delay in the voltage coming from R22 and R24 and avoids comparator IC16 misinterpreting whether the bulb is lit or not. As long as comparator IC16 determines that increased voltage is needed, an increased voltage will be furnished to one input of amplifier IC10 of the voltage regulator through diodes D16 and D18 and resistor R60 to increase the starting elevation. When the unit is functioning, these components have no further role. Resistors R48 and R50 adjust the voltage divider for power control into IC10. The other input of amplifier IC10 is tied to resistor R28 and capacitor C26.

Resistor R32 polarizes the output of voltage regulator comparator IC10. Capacitor C28 prevents comparator IC10 from oscillating and also slows or delays the output voltage. Resistor R30 limits the output voltage to a predetermined level to prevent a cyclic factor exceeding fifty percent of the output voltage from pulse wide modulation amplifier IC12. Zener diode DZ16 protects the respective circuits against static electricity generated by the kicking coil L12.

The output of voltage regulation amplifier IC10 is connected to one input of amplifier IC12 of the pulse wide modulation circuit. The other input is connected to the output of frequency oscillator and triangle wave generator IC14. Resistor R18 polarizes amplifier IC12 and transistor TR14. Zener diode DZ12 acts as a circuit protector to protect the circuit from high pulse tension generated by the starter circuit. The amplitude of the output of transistor TR14, and thus the amplitude of the signal output from transistor TR10 will always be dependent on the regulation level, and will be boosted in the event that the lamp does not ignite immediately. The voltage elevation corrects for any manufacturing tolerances of both the transformer L10 and the bulb 28. As the bulb ages the power control corrects for wear and tear of the electrodes and variations due to magnetism or shock.

The oscillator circuit is of a standard nature. Resistor R34 and capacitor C30 transform the IC14 square output signal to a near triangle at the input of amplifier IC12. Resistors R38, R40 divide the input voltage by two to obtain a fifty percent cycle factor on the input to amplifier IC14. Resistors R46, R46R and capacitor C34 combine to provide a time constant making the amplifier IC14 oscillate at a preferred frequency of 25 KHz. Resistor R36 polarizes the output of oscillator IC14, while resistors R42, R44 provide hysteresis on the non-inverse input to IC14 to make the amplifier oscillate. Capacitor C32 acts as a filter for the voltage provided through resistors R38, R40.

The time delay unit IC18 generates a three second time constant via resistor R52 and capacitor C36. Diode D14 resets the time constant to zero when the lamp is turned off. When the unit is switched on, after three seconds, the output of comparator IC18 changes from zero to one if the lamp does not light, as detected by the input to IC18 from bulb output tension divider R54, R56. The output from IC18 is connected to the switching unit circuitry at the input of amplifier IC20, which is also connected to the output of comparator IC16 for detecting if the lamp is lit, via resistors R58 and R62. The resistors R58 and R62 also polarize the outputs of comparators IC16 and IC18, respectively. The increased starting voltage elevation is cancelled by comparator IC16 and IC18 when the bulb is lit. Diode D16 also differentiates the activity of comparators IC16 and IC18 in a stand by stage through amplifier IC20. Under normal operation, the output of amplifier IC20 is at one. When the bulb does not light, the output will inverse to zero, and diode D20 connected to this output will stop the signals from oscillator IC14 from reaching transistor TR14, switching the transistor off and placing the unit on stand-by. A minimum of 2 seconds is required before the lamp can be re-lit.

The low voltage stand by portion of the circuit is in the lower right hand portion of FIG. 7. Comparator IC22 is arranged to determine if the battery or other input voltage falls below 9.8 to 10 volts. One of the inputs of comparator IC22 is connected via tension divider R54, R56 to the battery or power supply 144. Resistor R64 and capacitor C38 produce a short, 2 second delay. When the unit is switched off, capacitor C38 retains some energy, producing a time constant for the next operation which triggers the stand by unit. This precludes emission of morse code signals with the switches SW10, SW12, preventing damage to the bulb, which will not tolerate such frequent switching. Thus, this arrangement precludes damage to the bulb by requiring a minimum of two seconds delay before re-lighting the lamp. The other input of comparator IC22 is via voltage divider R68, R70. The comparator IC22 is triggered when 10 volts enter the voltage divider. When the battery voltage drops below 10 volts, diode D22 triggers a stand-by mode in the unit. Capacitor C40 produces a time constant with resistor R70. When the lamp is switched on initially, there will be a short period of time when the battery is below 10 volts. Capacitor C40 and resistor R70 ensure that this does not trigger the stand by unit. This time constant is shorter than that of resistor R64 and capacitor C38 so that IC22 is ready to function.

If the battery voltage subsequently falls below 9.8 volts, IC22 will go to zero at its output, D22 will then be triggered, and the unit will move to a stand-by mode. The lamp will be off until power is restored. SW10 and SW12 must be reactivated to relight the unit.

Transistor TR16 acts as a voltage regulator, which is stabilized by zener diode DZ14 and polarized by resistor R26. Capacitor C24 acts to filter out the voltage from transistor regulator TR16. DZ18 is a Zener diode.

Operation of the major components of the circuit will now be described in more detail. When the unit is connected to a power source, for example a battery, and the switches SW10, SW12 are off, the power switching circuit is fed but does not consume any power. When switches SW10, SW12 are switched on, the power switching circuit is switched on and should light the bulb within 3 seconds. As soon as switches SW10, SW12 are closed, oscillator IC14 will generate a square, 25 KHz signal, which is modified to a near triangle signal at the input to comparator IC12. The other input of comparator IC12 receives the regulation level given by comparator IC10. At the output of comparator IC12 the signals are amplified by amplifier TR14, and then activate the driver and power switching transistors TR10, TR12 through resistor R16. Driver and switching transistors TR10, TR12 then operate at 25 KHz. Power switching transistor TR10 activates transformer L10 to raise the voltage, charging capacitor C20 which ultimately discharges through transformer L12 to transmit a very high voltage peak into the Xenon bulb, which should ignite the bulb.

When the bulb is lit, the 100 volts in the bulb will decrease to approximately 14 volts, imposed by the bulb. The voltage will decrease progressively as long as comparator IC16 switches to a zero output. Diode D18 will not supply a voltage overflow to comparator IC10. Comparator IC18 will pass from a low voltage output level to a high voltage output level without any change in the process because diode D16 transmits low voltage from comparator IC16. Comparator IC20 will inverse the resultant output of comparators IC16 and IC18 from zero to one at its output. Comparator IC22 is at zero under normal operation of the lamp because the unit will be operating at more than 10 volts, so that comparator IC22 and diode D20 do not act.

If successive attempts fail to light the bulb, comparator IC18 will come into play because capacitor C36 increases the voltage progressively going through resistor R52, and this voltage will pass through dividers R54 and R56 to the other input of comparator IC18. Comparator IC20 will inverse from one to zero, and diode D20 will stop the IC12 output signal to transistor TR14. Comparator IC22 confirms that the output of comparator 252 is zero because diode D22 will lower the voltage of capacitor C40 below the voltage of capacitor C38. The unit goes on stand-by and consumes very little power.

If the battery voltage falls to 10 volts or lower, comparator IC22 will have a zero output and the unit will also go on stand-by, as explained above. If the bulb becomes disconnected during functioning of the unit, capacitor C22 will increase in voltage progressively, comparator IC16 will change from zero to one, comparator IC20 will transform the one to zero, and the unit goes on stand-by. The battery will re-charge. The unit will remain on stand-by until the switches SW10, SW12 are re-activated. The unit will not tolerate operation in a blinking, on-off fashion, and this type of operation is prevented by resistor R64 and capacitor C38 which introduce a time delay each time the unit is switched off. This protects the Xenon bulb against the improper operation of switches SW10, SW12.

The bulb starting circuitry acts both to protect the bulb against bulb damaging operation, for example switching on and off of the bulb too rapidly, or low voltage operation, and also regulates the power input to the bulb to compensate for any manufacturing variations or changes in the bulb as a result of the normal wear and tear of aging. The power regulation also stabilizes the arc position between the electrodes, avoiding variations in the light beam. The precise positioning of the arc at the focal point of the parabolic mirror produces a high intensity, high range, substantially parallel beam of light which is essentially a portable spotlight. The light efficiency is maximized by the precise positioning of the bulb. This lamp is particularly useful for underwater use when made suitably watertight by appropriate seals at the joints, since the high intensity will make it easier to see through small particles suspended in the water. It is also useful as a vehicle fog lamp, for example, or for a beacon. It is of long range, typically as far as the eye can see, to enable the user to see objects at a distance under reduced light conditions or darkness. The range of the lamp is typically greater than one mile, and it has an intensity of the order of 1 to 1¼ million Candlepower. The lamp projects a brilliant, narrow beam, with a diameter preferably of the order of 5.5 inches. In addition to being portable, the lamp produces a beam which will penetrate fog and smoke by using appropriate filters. The lamp can be powered from any convenient 12 volt battery source, such as an automobile having a 12 volt system.

Although a preferred embodiment of the invention has been described above by way of example only, it will be understood by those skilled in the field that modifications may be made to the disclosed embodiment without departing from the scope of the invention, which is defined by the appended claims.

I claim:

1. A lamp, comprising:

an outer housing including a handle portion for gripping by a user and a head portion having a window opening for transmitting a light beam;

a parabolic mirror mounted in the head portion facing said window opening;

an electric arc light bulb mounted at the focus of the parabolic mirror;

adjustable mounting means for adjustably mounting said light bulb relative to said mirror for allowing an electrode gap in the bulb to be located at the focus of the mirror;

securing means for locking the bulb in a selected, adjusted position; and power supply means for driving said electric arc bulb.

2. The lamp as claimed in claim 1, wherein said light bulb is a Xenon bulb.

3. The lamp as claimed in claim 1, wherein said parabolic mirror has an opening in the center of its surface through which said light bulb projects, said head portion having a base wall in which said adjustable mounting means is mounted, and one end of said bulb being mounted in said adjustable mounting means.

4. The lamp as claimed in claim 1, wherein said adjustable mounting means comprises first adjustment means for moving said lamp axially along a central axis of said mirror, and second adjustment means for tilting said lamp in any direction relative to the central axis of said mirror.

5. The lamp as claimed in claim 4, wherein said head portion has a base wall, said adjustable mounting means comprising a first part adjustably mounted in said base wall for transverse movement relative to said base wall, and a second part secured to one end of said bulb and adjustably mounted in said first part for tilting movement relative to the direction of adjustment of said first part, said parabolic mirror having a central opening aligned with said adjustable mounting means through which said bulb projects.

6. The lamp as claimed in claim 5, wherein base wall has a central opening, said first part being threadably engaged with said central opening.

7. The lamp as claimed in claim 5, wherein the first part has a central through bore through which said second part projects, said first and second parts having mating spherical seating surfaces for allowing tilting of said second part relative to said first part.

8. The lamp as claimed in claim 5, wherein said securing means comprises first locking means for locking said first part in a selected position relative to said base wall and second locking means for locking said second part in a selected orientation relative to said first part.

9. The lamp as claimed in claim 1, wherein said power supply means includes starter circuitry for starting and controlling operation of said light bulb.

10. The lamp as claimed in claim 9, wherein said starter circuitry is mounted in the handle portion of said housing.

11. The lamp as claimed in claim 10, including connector means at the outer end of said handle portion for connecting said starter circuitry to a power supply.

12. The lamp as claimed in claim 10, wherein said starter circuitry includes means for providing a regulated operating voltage to said bulb.

13. The lamp as claimed in claim 10, wherein said starter circuitry includes means for placing the circuit on stand-by and cutting off power to the bulb if the input power falls below a predetermined level.

14. The lamp as claimed in claim 10, wherein said starter circuitry includes means for placing the circuit on stand-by and cutting off power to the bulb if the bulb does not light within a predetermined time interval after the circuit is switched on.

15. The lamp as claimed in claim 10, wherein said starter circuitry includes delay means for delaying relighting of the bulb for a predetermined time interval after it is turned off.

16. The lamp as claimed in claim 12, wherein said means for providing a regulated operating voltage includes means for increasing power to the bulb if it remains unlit after the assembly is switched on.

17. The lamp as claimed in claim 1, including conductive wire means surrounding said bulb for energizing the interior of said bulb.

18. The lamp as claimed in claim 1, wherein said housing is generally cylindrical, and includes an anti-roll means projecting outwardly from said housing for standing said housing on a flat surface.

19. A method of manufacturing a high range lamp, comprising the steps of:

mounting a parabolic mirror in a head member having a window opening at one end;

sealing the window opening with a light transmitting glass disc;

inserting an electric arc bulb through aligned openings in the base of the head member and the mirror and loosely fastening an adjustable base mounting to which one end of the bulb is secured in the base opening;

lighting the bulb and detecting the output beam;

adjusting the position of the bulb by tilting it and moving it longitudinally along the central axis of the mirror until the output beam is substantially parallel and produces a spot with substantially no divergence, at which point the electrode gap of the bulb will be located precisely at the focus of the mirror;

securing the bulb at the detected focal position; and securing the head member to a handle member containing starter circuitry for operating the bulb.

* * * * *